US007359660B2

(12) United States Patent
Nakazato et al.

(10) Patent No.: US 7,359,660 B2
(45) Date of Patent: Apr. 15, 2008

(54) DEVELOPING DEVICE, PROCESS CARTRIDGE AND IMAGE FORMING APPARATUS LOADED THEREWITH

(75) Inventors: Yasushi Nakazato, Tokyo (JP); Shuji Hirai, Tokyo (JP); Masaaki Yamada, Tokyo (JP); Yoshinori Nakagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

(21) Appl. No.: 11/133,222

(22) Filed: May 20, 2005

(65) Prior Publication Data

US 2005/0265751 A1 Dec. 1, 2005

(30) Foreign Application Priority Data

May 31, 2004 (JP) ..... 2004-161447

(51) Int. Cl.
*G03G 15/08* (2006.01)

(52) U.S. Cl. ..... 399/259; 399/262

(58) Field of Classification Search ..... 399/107, 399/111, 119, 120, 222, 252, 254, 255, 258, 399/259, 262; 222/DIG. 1
See application file for complete search history.

(56) References Cited

U.S. PATENT DOCUMENTS

| | | | | |
|---|---|---|---|---|
| 4,891,673 | A * | 1/1990 | Buell | 399/257 |
| 4,931,838 | A * | 6/1990 | Ban et al. | 399/106 |
| 6,009,295 | A * | 12/1999 | Kimura et al. | 399/257 |
| 6,466,749 | B1 * | 10/2002 | O'Brien | 399/27 |
| 6,587,661 | B1 * | 7/2003 | Shimmura et al. | 399/257 |
| 6,819,892 | B2 | 11/2004 | Nakazato et al. | |
| 6,941,090 | B2 * | 9/2005 | Uchida et al. | 399/98 |
| 2004/0013442 | A1 | 1/2004 | Suzuki et al. | |
| 2005/0265751 | A1 | 12/2005 | Nakazato et al. | |

OTHER PUBLICATIONS

U.S. Appl. No. 11/546,251, filed Oct. 12, 2006, Tsukamoto et al.
U.S. Appl. No. 10/612,146, filed Jul. 03, 2003, Miura et al.

* cited by examiner

*Primary Examiner*—Hoan Tran
(74) *Attorney, Agent, or Firm*—Oblon, Spivak, McClelland, Maier & Neustadt, P.C.

(57) ABSTRACT

A developing device of the present invention is operable with a two-ingredient type developer by mixing and agitating toner grains and carrier grains to thereby electrify the toner grains. At least the carrier grains are sealed in a space formed in the developing device until the developing device starts being used while the toner grains are introduced in the developing device at the start of use.

7 Claims, 7 Drawing Sheets

DEVELOPING DEVICE, PROCESS CARTRIDGE AND IMAGE FORMING APPARATUS LOADED THEREWITH

BACKGROUND OF THE INVENTION

1. Field of the Invention

The present invention relates to a developing device, a process cartridge and an image forming apparatus loaded therewith and more particularly to charge control effected with a two-ingredient type developer, i.e., a toner and carrier mixture.

2. Description of the Background Art

Generally, in an electrophotographic image forming apparatus, charging means, exposing means, developing means, image transferring means, separating means, cleaning means and discharging means are arranged around an image carrier implemented by a photoconductive element. To meet the increasing demand for easy maintenance of such processing means, it has been proposed to construct part of them into a single process cartridge in, e.g., Japanese Patent Laid-Open Patent Publication No. 2001-83862.

On the other hand, it is a common practice with a developing device to use a two-ingredient type developer or toner and carrier mixture. Toner grains and carrier grains, constituting the developer, are mixed together and electrified thereby before development, so that the toner grains are charged and then deposited on a latent image formed on the image carrier. While the two-ingredient type developer is usually mixed and agitated in the developing device, it is also ready to be done so when a process cartridge, including the developing device, is mounted to an image forming apparatus.

In an image forming apparatus of the type capable of forming a full-color image by superposing images of different colors, toner grains and carrier grains are also mixed and agitated in a developing device arranged in the apparatus. In this type of image forming apparatus, a particular process cartridge is assigned to each color and replaced independently of the others when its life ends. However, preparing a particular process cartridge for each color not only increases management costs at the user's used, but also increases costs at the manufacturer's side including parts cost and other machining costs.

In light of the above, Laid-Open Publication No. 2001-83862 mentioned above, for example, teaches process cartridges having an identical configuration for thereby making it unnecessary to produce a particular process cartridge for each color.

On the other hand, when toner grains and carrier grains are electrified by being mixed together, a charging characteristic varies in dependence on environmental conditions, particularly humidity, in a portion where the different kinds of grains are mixed, as disclosed in, e.g., Japanese Patent Laid-Open Publication No. 9-146360. This is also true when process cartridges are used.

While process cartridges identical in structure are successful to reduce the kinds of process cartridges required and therefore costs, they have the following problems left unsolved. A developer stored in each process cartridge is of a particular color, so that each process cartridge must be mounted to a particular position on an image forming apparatus. Therefore, even if the process cartridges are provided with the same structure, there must be prepared process cartridges each storing a developer of a particular color. This fails to substantially reduce the kinds of process cartridges and therefore management costs.

Further, when fresh toner is replenished to a conventional process cartridge, a period of time necessary for a preselected charging characteristic to be established is extended, delaying the start or the restart of image formation. Particularly, because an increase or a decrease in the amount of charge to be deposited on toner is susceptible to humidity, it is likely that the above period of time is extended by the influence of humidity in the mixing and agitating space also. Moreover, when part of the developer is used for development in a defectively electrified condition, toner is apt to fly about due to weak adhesion to a latent image and smear the inside of the apparatus.

SUMMARY OF THE INVENTION

It is an object of the present invention to provide a developing device, a process cartridge and an image forming apparatus loaded therewith that reduce production and management costs and prevent the charging characteristic of toner from being degraded.

A developing device of the present invention is operable with a two-ingredient type developer by mixing and agitating toner grains and carrier grains, constituting the developer, to thereby electrify the toner. At least the carrier grains are sealed in a space formed in the developing device until the developing device starts being used while the toner grains are introduced in the developing device at the start of use.

A process cartridge and an image forming apparatus loaded with the above developing device are also disclosed.

BRIEF DESCRIPTION OF THE DRAWINGS

The above and other objects, features and advantages of the present invention will become more apparent from the following detained description taken with the accompanying drawings in which.

DESCRIPTION OF THE PREFERRED EMBODIMENTS

Referring to FIGS. 1A, 1B, 2 and 3 of the drawings, image forming apparatuses, each including a particular process cartridge of the present invention and including a developing device, are shown and operable in a full-color mode. The image forming apparatus shown in FIGS. 1A and 1B has a tandem arrangement in which a plurality of photoconductive elements or image carriers are positioned side by side along an intermediate image transfer belt or intermediate image transfer body. The image forming apparatus shown in FIG. 2 differs from the apparatus of FIGS. 1A and 1B in that the tandem arrangement is laid out in the vertical direction so as to convey a paper sheet or similar recording medium in the vertical direction. Further, the image forming apparatus shown in FIG. 3 has a revolver type configuration in which a plurality of developing devices are positioned in such a manner as to selectively face a single image carrier.

Figure 1A:
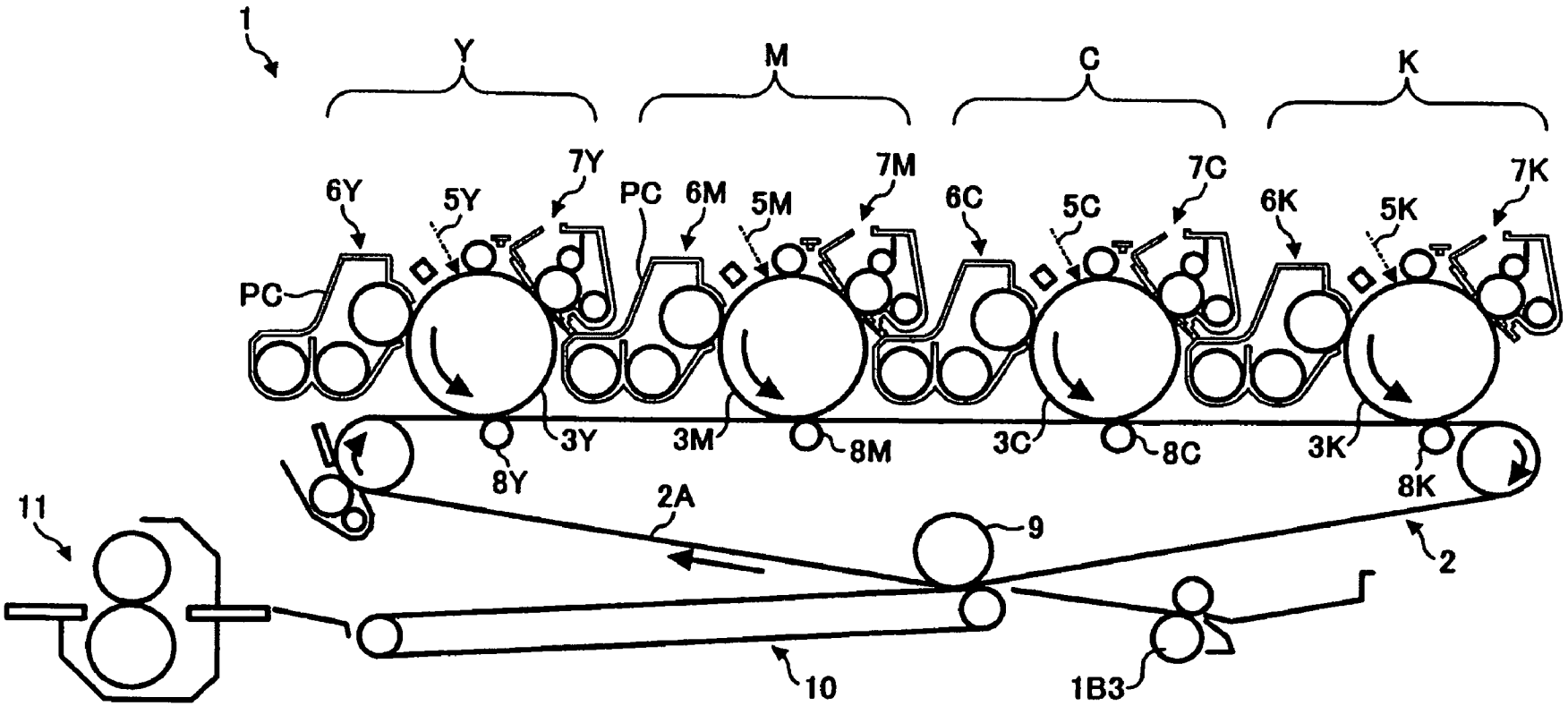
FIG. 1A shows a specific image forming apparatus to which a process cartridge, including a developing device of the present invention, is applied.
Figure 1B:
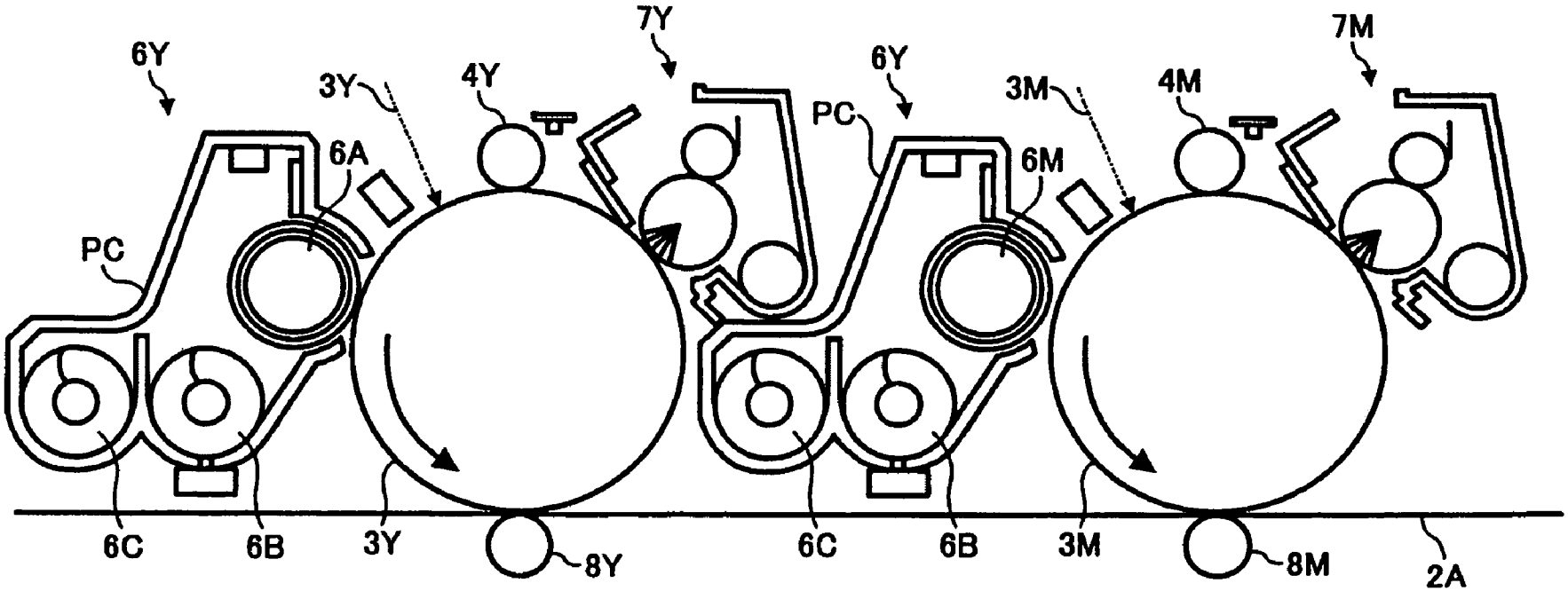
FIG. 1B shows a specific configuration of the developing device included in the configuration of FIG. 1A.
Figure 2:
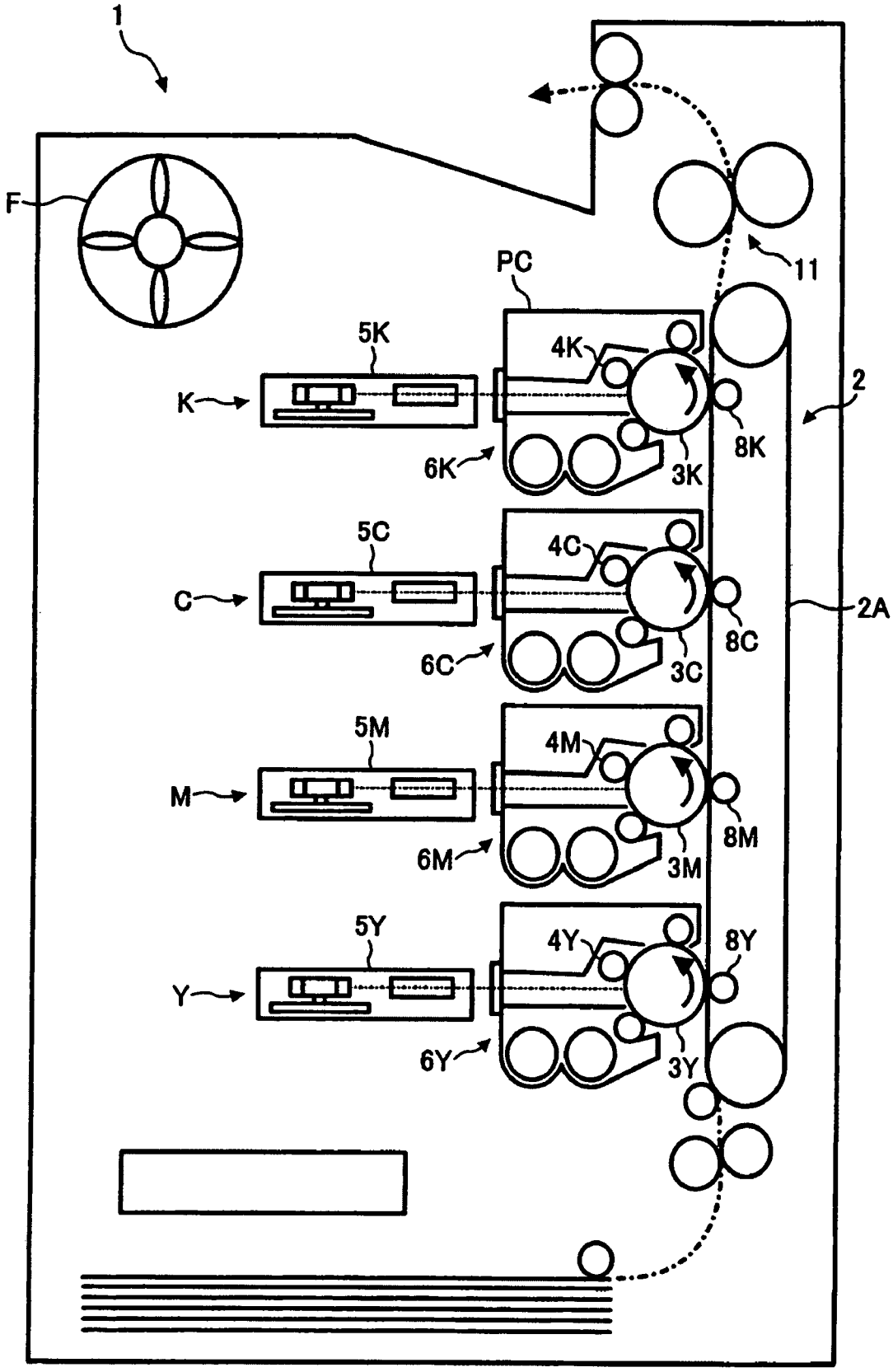
FIG. 2 shows another specific image forming apparatus to which a process cartridge, including a developing device of the present invention, is applied.

More specifically, the image forming apparatuses shown in FIGS. 1A and 1B and 2, generally 1, each include image forming stations Y (yellow), C (cyan), M (magenta) and K (black) sequentially arranged along an intermediate image transfer belt 2A, which constitutes a primary image transferring device 2. The image forming stations Y, C, M and K each include a photoconductive drum 3, which is a specific form of a photoconductive element or image carrier. In the drawings, members belonging to each image forming station are distinguished from members belonging to the other image forming stations by suffixes Y, M, C and K.

Arranged around the photoconductive drum (simply drum hereinafter) 3 in the direction of rotation of the drum 3 are a charger 4, a writing device 5, a developing device 6 and a cleaning device 7. Biasing means 8 for primary image transfer each face one of the drums 3 with the intermediary of the intermediate image transfer belt (simply belt hereinafter) 2A.

As for the construction shown in FIGS. 1A and 1B, the developing device 6 located at each image forming station develops a latent image formed on the drum 3 with a developer to thereby form a corresponding toner image, as shown in FIG. 1B. For this purpose, the developing device 6 includes a rotatable sleeve 6A facing the drum 3 and agitating/feeding means 6B and 6C configured to feed the developer to the sleeve 6A while charging it by friction. In this specific configuration, the agitating/feeding means 6B and 6C each are implemented as a screw or a roller while the developer is a two-component type developer, i.e., a toner and carrier mixture.

In the specific configurations shown in FIGS. 1A and 1B and 2, toner images formed at the consecutive image forming stations are sequentially transferred from the drums 3 to the belt 2A one above the other, completing a full-color image on the belt 2A. This image transfer is the primary image transfer. The full-color image is then transferred from the belt 2A to a paper sheet or similar recording medium fed from a sheet feeding section by a secondary image transferring device 9. Subsequently, the paper sheet with the full-color image is conveyed to a fixing device 11 by a conveyor 10, has the image fixed by the fixing device 11 and then driven out of the apparatus 1.

In the configuration shown in FIGS. 1A and 1B, the developing device 6 is configured as a so-called process cartridge PC removable from the apparatus 1 independently of the drum 3. By contrast, in the configuration shown in FIG. 2, the drum 3, charger 4 and cleaning device 7 are constructed into a process cartridge PC' together with the developing device 6. The process cartridge PC' is also removable from the apparatus 1.

Figure 3:
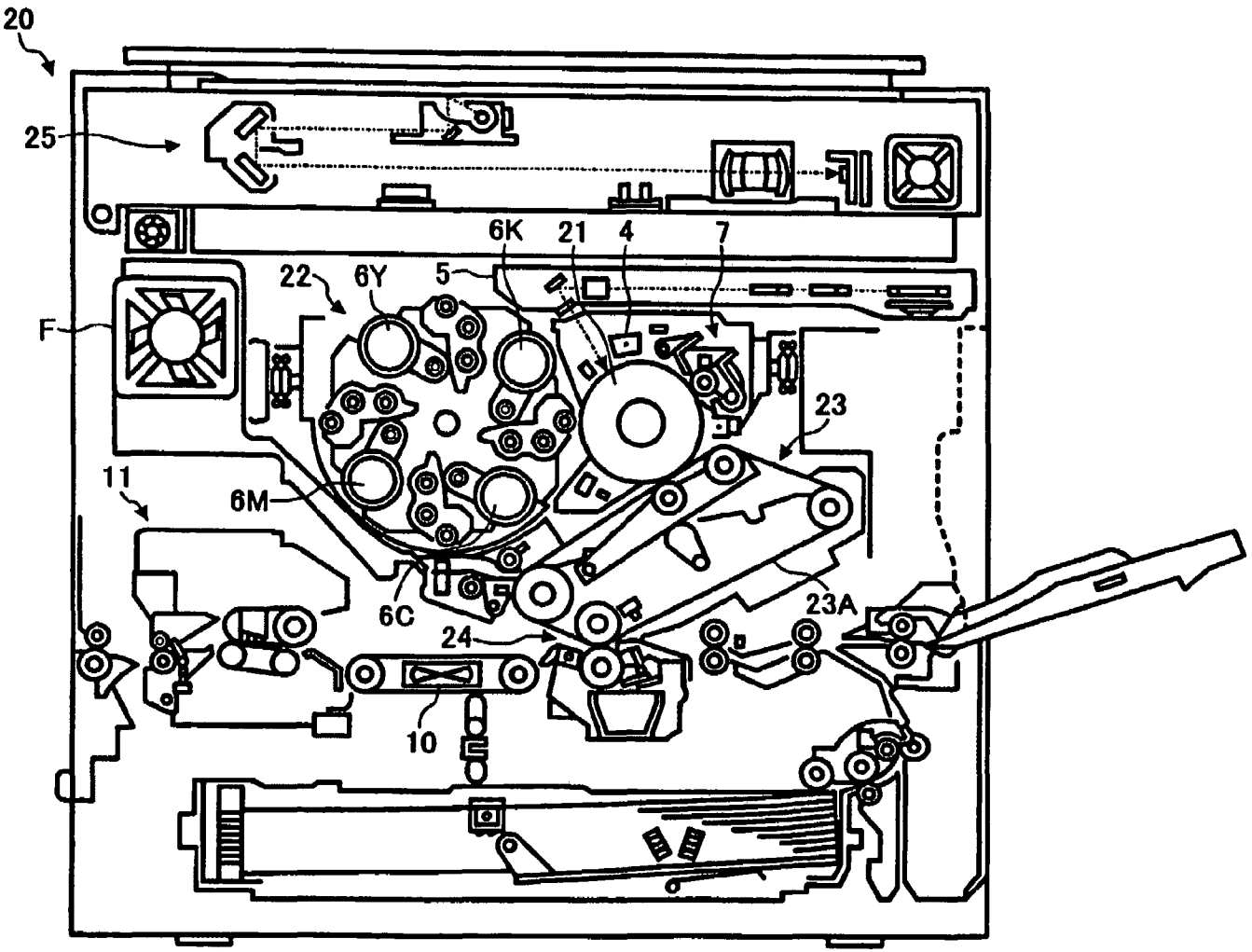
FIG. 3 shows still another specific image forming apparatus to which a process cartridge, including a developing device of the present invention, is applied.

The image forming apparatus shown in FIG. 3, generally designated by the reference numeral 20 for convenience, differs from the image apparatuses of FIGS. 1A and 1B and 2 in that the color-by-color image forming stations are absent. More specifically, the image forming apparatus 20 includes a single photoconductive drum 21 and a revolver support 22 that includes developing devices each corresponding to a particular color of latent image to be formed on the drum 21. The revolver support 21 is rotatable to selectively cause one of the developing devices to face the drum 21 and develop a latent image formed on the drum 21.

Toner images, sequentially formed on the drum 21 by the above procedure, are sequentially transferred to a primary image transfer belt 23A one above the other, forming a full-color image on the belt 23A. The full-color image is then transferred from the belt 23A to a paper sheet or similar recording medium fed from a sheet feeding device by a secondary image transferring device 24. Thereafter, the paper sheet with the full-color image is driven out of the apparatus 1 via a fixing device in the same manner as in FIGS. 1A and 1B and 2. The specific configurations of FIGS. 2 and 3 each further include a cooling fan F while the configuration of FIG. 3 additionally includes a document scanning section 25.

It has been customary with an image forming apparatus to store a two-ingredient type developer in a developing device and replenish fresh toner to the developing device when the toner content of the developer decreases. With this configuration, however, it is necessary to install developing devices each storing a particular color of toner and to prepare the same number of developing devices as the number of colors for replacement or similar maintenance. This forces the manufacturer to produce a number of developing devices at high material and management costs and forces the user to bear high management costs originally irrelevant to image formation, e.g. a space for stocking the developing devices.

In light of the above, a preferred embodiment of the developing device in accordance with the present invention reduces such costs by proving a developing device with a unique configuration, as will be described hereinafter. Briefly, in the illustrative embodiment, toner of a particular color is not mixed with a carrier in a developing device, but a carrier is sealed in a developing device alone. In this condition, when a new developing device starts being used, toner of a desired color is introduced in the developing device.

Figure 4:
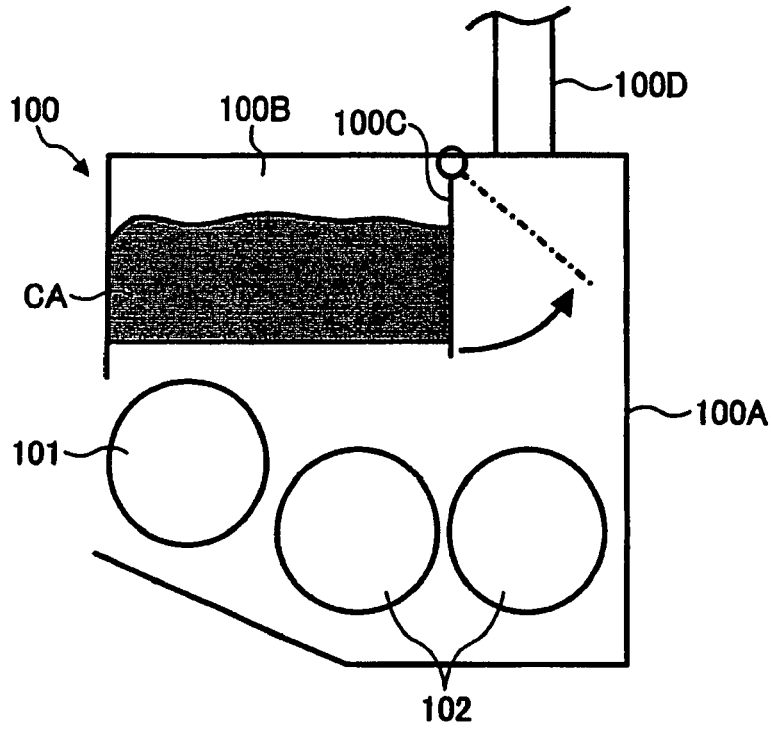
FIG. 4 is a fragmentary view showing part of a preferred embodiment of the developing device in accordance with the present invention.

FIG. 4 shows a developing device provided with the above unique configuration. As shown, the developing device, generally 100, has a casing 100A accommodating a sleeve 101 and agitating/feeding means 102, which may be a screw or a roller. The casing 100A has a space 100B independent of a space for agitating and feeding toner and carrier. Carrier grains CA are sealed in the space 100B alone.

The space 100B is hermetically sealed except a part thereof so as to prevent outside air from entering it. A shutter or similar closure member 100C is mounted on the above part of the space 100B in such a manner as to be openable from a position indicated by a solid line in FIG. 4 to a position indicated by a phantom line.

More specifically, the closure member 100C is located at a position where the agitating and feeding space and space 100 are communicated to each other and is held closed until the developing device 100 starts being used. When the developing device 100 starts being used, the closure member 100C is opened in synchronism with the entry of toner grains via a toner inlet 100D, which is formed in the casing 100A, to thereby mix the carrier grains CA with the toner grains.

On the other hand, the space 100B in which the carrier grains CA are sealed is maintained in an environment whose relative humidity (RH) is 60% or above, preferably an environment containing moisture of between 0.001 and 0.009 in terms of the gas weight ratio of the atmosphere. In this manner, the carrier grains CA are sealed in the exclusive space 100B independent of the space for mixing the toner grains and is therefore protected from deterioration ascribable to contact with gases contained in the atmosphere.

While the carrier grains CA are sealed in the exclusive space 100B formed in the developing device 100 in the illustrative embodiment, they may alternatively be sealed in a process cartridge including the entire developing device 100 or the developing device 100 and a photoconductive element, a charging unit and a cleaning unit, which form part of image forming process units, and entirely wrapped in a vinyl sack or similar highly airtight material with an opening thereof welded.

When use is made of a polymeric sheet material for the wrapping purpose mentioned above, a small amount of air is apt to permeate through the sheet in a long period of time. In such a case, therefore, it is preferable to form a sack with aluminum foil and highly airtight sheets sandwiching it. If desired, aluminum foil may be replaced with, e.g., a fibriform material for enhancing mechanical strength and airtightness to thereby deairate the inside. In any case, airtight packaging protects the packaged members from the influence of extraneous ultraviolet rays, electron rays and static electricity, which are the cause of deterioration. Particularly, when the carrier grains CA are mixed and agitated with fresh toner grains, a necessary charge characteristic can be rapidly established.

Figure 5:
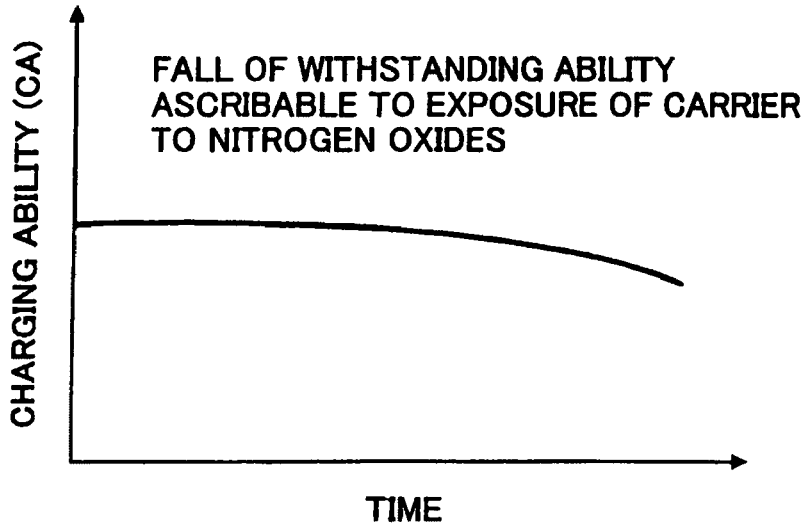
FIG. 5 shows a curve indicative of a relation between the amount of nitrogen oxides and the charging ability.

FIG. 5 shows a curve representative of the deterioration of the carrier grains ascribable to their contact with the atmospheric air, more particularly a relation between the amount of nitrogen oxides and the charging ability, as determined by experiments. As shown, the charging ability of the carrier grains decreases with an increase in the amount of nitrogen oxides, i.e., an increase in the amount of contact with the atmospheric air. Stated another way, when the carrier grains are sealed alone, more ion-conductive compounds easily deposit on the surfaces of the carrier grains than when the carrier grains are mixed with toner grains because of the deposition of toner. Presumably, therefore, the compounds deposited on the carrier grains cause the surface characteristic of the carrier grains to vary in the event of electrification, thereby lowering the charging ability of the carrier grains.

On the other hand, the electrification ability of the carrier grains varies due to, among the others, the fact that the carrier grains, when existing alone, rub against each other when subjected to vibration or similar impact due to the absence of toner grains that would cushion the surfaces of the carrier grains. More specifically, the surface conditions of the carrier grains, which effect charging, vary due to deterioration ascribable to friction acting between the carrier grains to thereby lower the charging ability. Moreover, electrification between the carrier grains charges the carrier grains themselves to different polarities. Consequently, part of the carrier grains is charged to the polarity opposite to expected one, obstructing electrification between the carrier grains and the toner grains.

By contrast, in accordance with the illustrative embodiment, the carrier grains are isolated from the outside and therefore protected from the deposition of ionized compounds, so that electrification is prevented from being obstructed. Further, by increasing the packing ratio of the carrier grains in the space 100B, if the space 100B is sufficiently small, it is possible to protect the carrier grains CA from frictional deterioration ascribable to the rubbing of the carrier grains against each other in the event of vibration.

On the other hand, by establishing the environmental conditions stated earlier in the space 100B, it is possible to accelerate the charging of toner grains when the carrier grains begin to contact toner the grains and to increase the adhering power between them.

Figure 6:
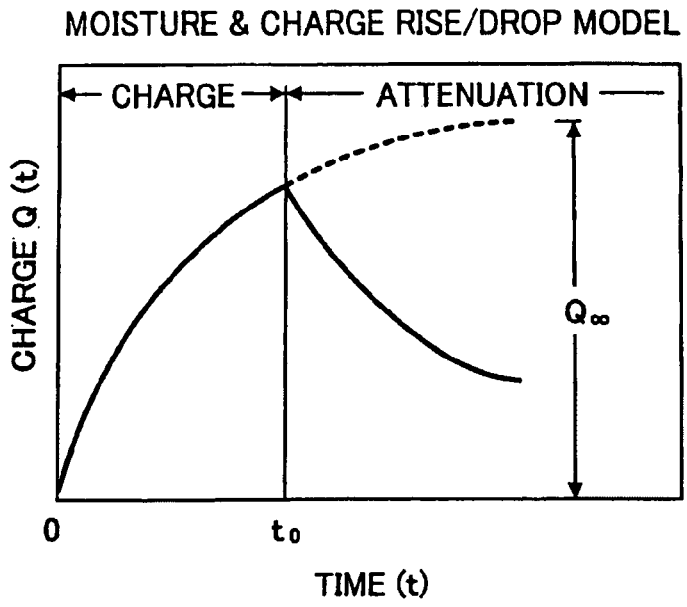
FIG. 6 shows a curve indicative of a relation between moisture and the start-up of charging.

Regarding the start of charging, FIG. 6 shows that one of the toner and carrier grains lower in resistivity and therefore more susceptible to moisture than the other in the event of charge exchange is charged more rapidly than the other, as taught by Manabu Takeuchi in Journal of Imaging Society of Japan, Vol. 39, pp. 270-271 (Aug. 15, 2000). It follows that by limiting the amount of moisture in the space 100B assigned to the carrier grains CA, it is possible to accelerate charging for thereby reducing a period of time necessary for the connection of carrier and toner grains.

In the illustrative embodiment, when the fresh carrier CA grains in the space 100B are introduced in the mixing space at the same time as fresh toner grains, the carrier and toner grains are agitated and mixed together with the result that the toner grains being to be charged. After the carrier grains CA with the particular amount of moisture have been delivered from the space 100B and actually used, the mixing space is dehumidified in order to prevent the leakage of charge from being aggravated in dependence on the amount of moisture.

Figure 7:
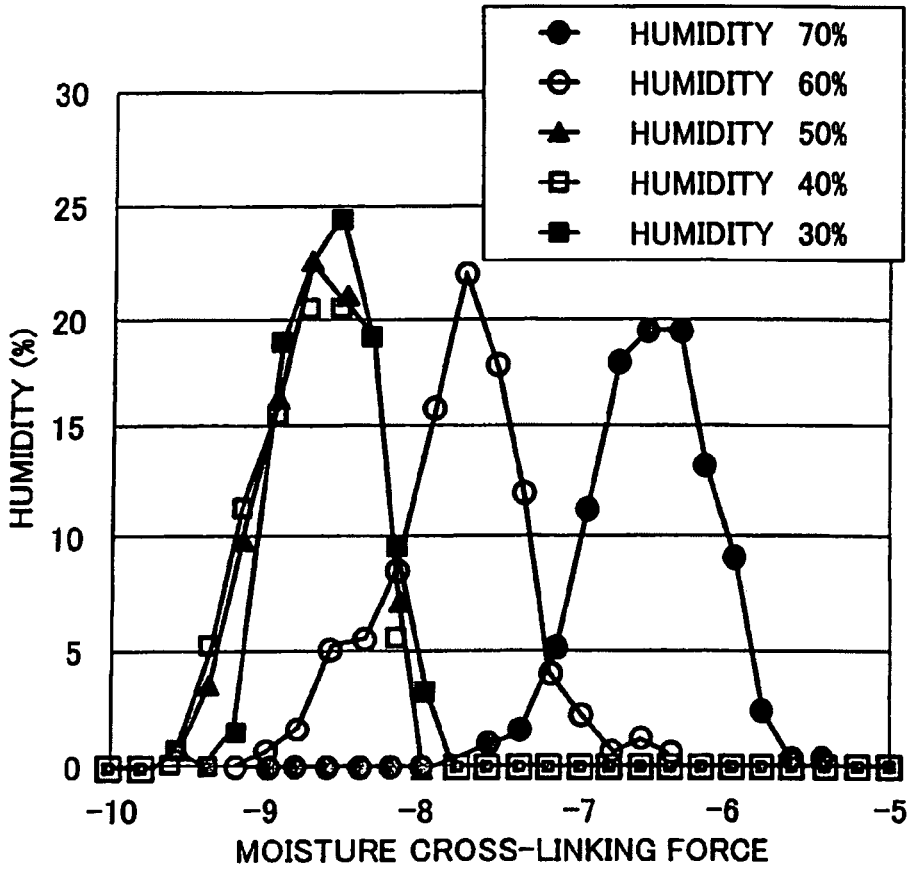
FIG. 7 shows curves indicative of a relation between relative humidity and adhesion of toner grains to carrier grains.

On the other hand, it is known that the adhesion of toner grains to carrier grains is dependent not only on van der Waals force and static electricity but also on moisture cross-linking force, as taught in Japan Hardcopy Journal 2003, pp. 305 by Toyohiko Hiruta and Manabu Takeda. FIG. 7 plots a relation between relative humidity and the adhering force of toner grains to carrier grains. As shown, the adhering force shifts to the higher side when temperature is 20° C. and relative humidity (RH) is 60% or above.

In light of the above, the illustrative embodiment determines moisture at the relative humidity and weight ratio in the atmosphere stated above. It follows that as soon as a developing device starts operating with toner grains introduced therein and causes electrification to occur, the adhering force of toner grains to carrier grains is increased while the start-up of charging is accelerated. Consequently, a preselected amount of charge and toner adhesion necessary for image formation are rapidly established, reducing a waiting time and the scattering of toner ascribable to defective charging.

As stated above, in the illustrative embodiment, the developing device 100 does not store a mixture of carrier and toner of a particular color, but stores only a carrier until the start of use. Therefore, developing devices with the same structure should only be prepared instead of developing devices each corresponding to a particular color of toner. Stated another way, when a new developing device is to be used, it suffices to introduce toner of a color corresponding to the developing device. This makes it unnecessary to prepare developing devices each corresponding to a particular color and therefore reduces the kinds of developing devices, which are supplies, for thereby preventing machining and management costs from increasing.

Further, the space 100B in which the carrier grains CA are sealed alone is isolated from the atmospheric air and maintained at preselected relative humidity and preselected amount of moisture. This successfully accelerates the start-up of charging and guarantees the adhering force of the toner grains to the carrier grains to thereby reduce the waiting time up to the start or the restart of image formation and the scattering of toner grains ascribable to defective charging, which would smear the inside of the apparatus 1.

In a modification of the illustrative embodiment shown in FIG. 4, zeolite or similar humidity control means, not shown, is used to maintain the preselected relative humidity and amount of moisture in the space 100B allocated to the carrier grains CA.

An alternative embodiment of the present invention will be described hereinafter. This embodiment is configured to protect the carrier grains CA sealed in the space 100B from deterioration. Generally, the carrier grains CA sealed in the space 100B alone each are made up of ion oxide, which forms a core for forming a magnet brush, and resin coating the ion oxide. Although such carrier grains CA are resistive to oxidation when brought into contact with the atmospheric air, they repeatedly, directly hit against each other when subjected to vibration or similar impact due to the absence of toner grains or shock-absorbing members. Consequently, active oxygen is produced on the surfaces of the carrier grains and oxidize and deteriorate them.

In light of the above, the illustrative embodiment maintains the oxygen content of the space 100B lower than the oxygen content of the atmospheric air inclusive. For this purpose, a gas with a low oxygen content, preferably an inactive gas containing moisture, may be filled in the space 200B beforehand. Such a gas may be implemented by an inexpensive nitrogen gas by way of example. Further, oxidation may be obviated by use of AGELESS (trade name) or similar oxygen absorbing member.

As stated above, in the illustrative embodiment, the oxygen content in the space 100B in which the carrier grains CA are sealed alone is maintained lower than the oxygen content of the atmospheric air inclusive. This is successful to protect the carrier grains CA from oxidation and maintain humidity in the space 100B constant for thereby preventing the life of the carrier CA from decreasing and enhancing the start of charging and adhering force when toner grains are introduced.

Another alternative embodiment of the present invention will be described hereinafter and is characterized in that pressure inside the space 100B, which is maintained at preselected humidity, is held lower than the atmospheric pressure. More specifically, dew condensation is likely to occur in the space 100B because moisture is present in the space 100B and lowers environmental temperature. The illustrative embodiment limits pressure inside the space 100B such that the evaporation of moisture in the space 100B is promoted to thereby maintain the moisture in a vapor state, so that moisture is prevented from being localized in part of the carrier grains CA. It follows that moisture, thus evenly distributed to the entire carrier grains CA, prevents the charge from being localized when the carrier grains CA is charged with toner grains by friction, obviating defective charging.

Another modification of the developing device shown in FIG. will be described hereinafter. As shown in FIGS. 2 and 3, it is a common practice with an image forming apparatus to use a cooling fan for exhausting hot air to thereby prevent the temperature of inside air from rising on the basis of heat exchange. However, when air inside the apparatus 1 is caused to flow by the cooling fan, outside air flows into the developing device as well with the result that inside air follows the moisture characteristic of outside air. Consequently, when part of the space 100B in which the carrier grains CA are sealed is opened, the relative humidity of the carrier grains CA is apt to rise to an unusual degree also. If the two-ingredient type developer is used in the above condition, the developing ability is lowered due to an increase in van del Waals force and the fall of charge level ascribable to the fall of resistance brought about by excessive moisture. The modification, which will be described with reference to FIG. 8 hereinafter, solves this problem by substituting dry air for outside air introduced by a cooling fan.

Figure 8:
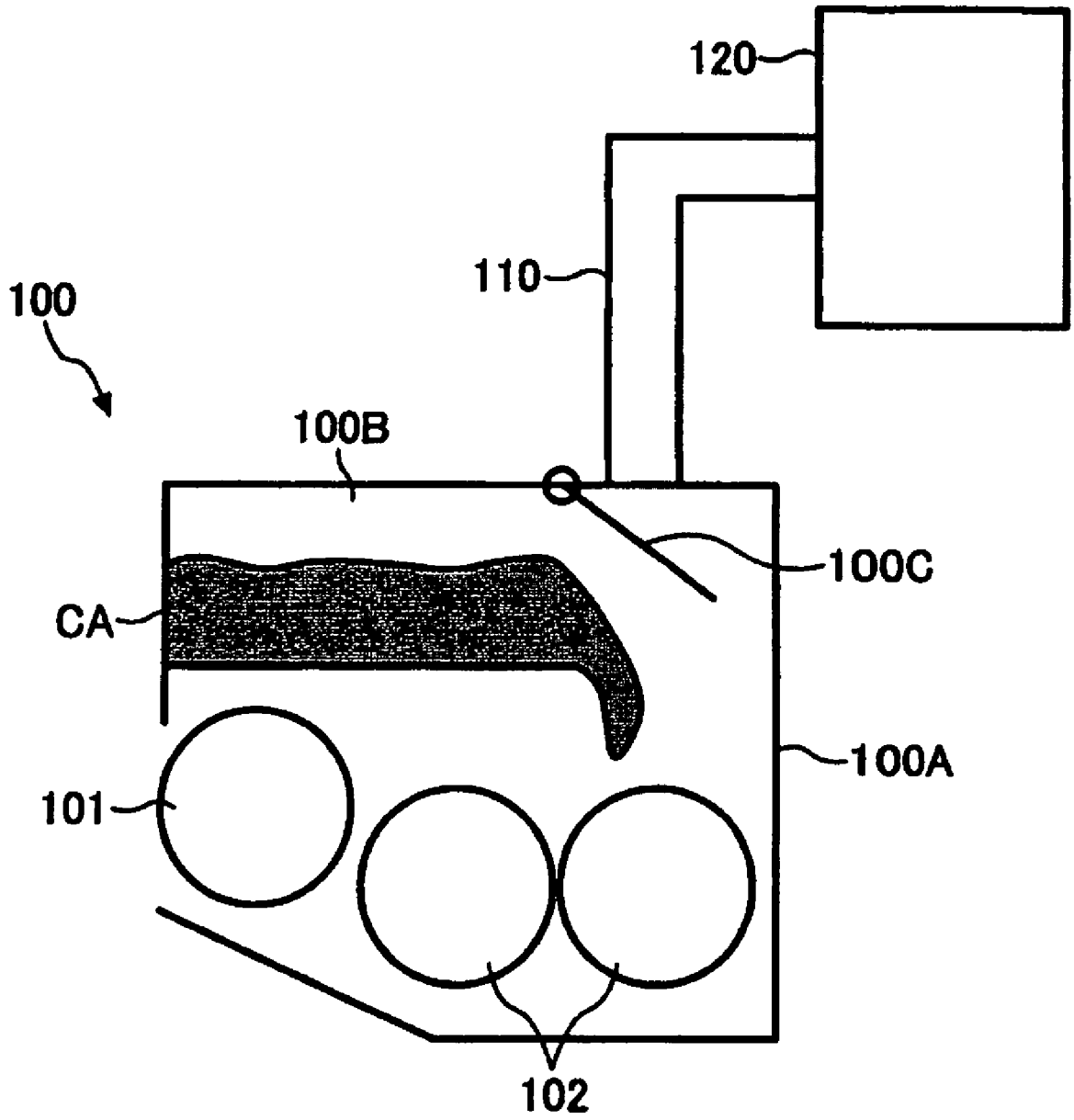
FIG. 8 is a fragmentary view showing a modification of the embodiment shown in FIG. 4.

As shown in FIG. 8, a dry-air source 120 is communicated to the developing device 100 by a duct 100 for sending dry air into the developing device 100. To produce dry air, the dry-air source 120 may use a moisture separating method implemented by a functional film or a cooling condensation method implemented by a peltiert device.

While the illustrative embodiments described above are applied to a developing device, the present invention is similarly applicable to a process cartridge removably mounted to an image forming apparatus and including a developing device. In the case of a process cartridge, at least the developing device may be surrounded airtight by a light-intercepting member. This configuration not only isolates carrier grains sealed in the developing device from outside air, but also prevents the relative humidity and amount of moisture in a space accommodating the carrier grains from varying due to temperature elevation ascribable to extraneous light. Consequently, not only the carrier grains are protected from deterioration ascribable to its contact with outside air, but also the charge start-up characteristic and adhering force to act between the carrier and toner are prevented from decreasing due to the variation of relative humidity or the amount of moisture, obviating the scattering of toner ascribable to defective charging.

In summary, it will be seen that the present invention provides an image forming apparatus having various unprecedented advantages, as enumerated below.

(1) A carrier is sealed in a developing device alone until the developing device starts being used, so that all developing devices can be provided with the same configuration without regard to the color of toner, i.e., developing devices each storing a particular color of carrier do not have to be prepared. It is therefore only necessary to manage parts for introducing toners of different colors. This reduces the machining cost for common parts and prevents parts management cost from increasing.

(2) A space in which the carrier is sealed is held airtight until the start of use. Particularly, when the entire developing device is wrapped in a highly airtight material, the space accommodating the carrier is maintained in the same environment and therefore protects the carrier from deterioration. Further, when the airtight material is implemented by aluminum foil sandwiched between highly airtight sheets, the developing device is free from the influence of extraneous violet rays, electron rays and static electricity, the carrier is protected from deterioration over a long time. Consequently, the quality of the carrier, which constitutes part of a new developer, is guaranteed and insures rapid charging of the developer.

(3) Particularly, in the above configuration, humidity that effects the charging characteristic of toner is maintained substantially constant, reducing a charging time and therefore implementing an amount of charge required of a two-ingredient type developer in a short period of time. In addition, by limiting humidity in the space allocated to the carrier, it is possible to obviate defective charging that would cause toner to fly about and would thereby smear the inside of an image forming apparatus.

(4) The humidity of the space thus controlled allows an optimum environment for enhancing the charging of toner to be established. Particularly, such humidity control allows the carrier to adhere to the toner on the basis not only of static electricity induced on the toner at the time of charging but also of a moisture cross-linking force to act between the carrier and the toner. This successfully reduces a time necessary for a preselected amount of charge to be induced for thereby reducing a waiting time up to the start of image formation.

(5) A gas, containing oxygen lower in content than the atmospheric air inclusive, is filled in the exclusive space for the carrier so as to protect the carrier from oxidation and thereby prevent the charging characteristic and durability from being degraded when the carrier is stored over a long time.

(6) An oxygen-absorbing member is disposed in the space allotted to the carrier so as to protect the carrier sealed in the space from oxidation and thereby allow the oxygen to be stored over a long time without deterioration.

(7) The space in which the carrier is sealed is maintained at pressure lower than the atmospheric pressure so as to obviate dew condensation for thereby preventing moisture from being localized in the carrier. This insures a uniform charging characteristic in the event of agitation for thereby rapidly producing a developer free from defectively charged toner.

(8) At least the developing device included in a process cartridge is maintained airtight until the process cartridge starts being used. The carrier is therefore maintained at constant humidity and can be stably charged.

(9) The process cartridge is maintained airtight by a light-intercepting member until it starts being used. This prevents humidity in the space allocated to the carrier from being varied. More specifically, temperature elevation would repeatedly produce vapor while temperature drop would repeatedly bring about dew condensation, causing moisture to be localized in the space. It is therefore possible to maintain the entire carrier at constant humidity and allow adhesion to be enhanced by a moisture cross-linking force between the carrier and the toner.

(10) When the process cartridge includes the developing device, the humidity of the space, which accommodates the carrier and to which a toner replenishing portion is connectable, is controlled. This prevents the humidity of the carrier from varying until the replenishment of toner and therefore obviates the degradation of adhesion of the carrier and toner ascribable to the variation of carrier humidity, insuring rapid start of image formation.

Various modifications will become possible for those skilled in the art after receiving the teachings of the present disclosure without departing from the scope thereof.

What is claimed is:

1. A developing device configured to operate with a two-ingredient type developer by mixing and agitating a toner and a carrier comprising:

a first space accommodating a carrier, which carrier is a component of the two-ingredient type developer; and a second space, wherein the developing device is configured to mix and agitate a toner and the carrier and electrify said toner in the second space, at least said carrier is sealed in the first space formed in the developing device until said developing device starts being used, said toner is introduced in said developing device at the start of use, and said first space accommodating the carrier is controlled in humidity.

2. The developing device as claimed in claim 1, wherein said first space in which the carrier is sealed is maintained at relative humidity of 60% at a temperature of 20° C.

3. The developing device as claimed in claim 1, wherein said first space, accommodating the carrier, is held in a condition containing moisture whose gas weight ratio is 0.001 or above, preferably 0.009 or above, in the atmosphere.

4. A developing device configured to operate with a two-ingredient type developer by mixing and agitating a toner and a carrier comprising:

a first space accommodating a carrier, which carrier is a component of the two-ingredient type developer; and a second space, wherein the developing device is configured to mix and agitate a toner and the carrier and electrify said toner in the second space, at least said carrier is sealed in a space formed in the developing device until said developing device starts being used, said toner is introduced in said developing device at the start of use, said first space accommodating the carrier is filled with a gas containing oxygen lower in content than oxygen present in the atmosphere.

5. The developing device as claimed in claim 4, wherein the gas comprises a nitrogen gas for lowering an oxygen content.

6. The developing device as claimed in claim 4, wherein an oxygen-absorbing member is positioned at least in the second space to thereby lower the oxygen content.

7. A developing device configured to operate with a two-ingredient type developer by mixing and agitating a toner and a carrier comprising:

a first space accommodating a carrier, which carrier is a component of the two-ingredient type developer; and a second space, wherein the developing device is configured to mix and agitate a toner and the carrier and electrify said toner in the second space, at least said carrier is sealed in the first space formed in the developing device until said developing device starts being used, said toner is introduced in said developing device at the start of use, and said first space accommodating the carrier is maintained at a pressure lower than the atmospheric pressure.

* * * * *